US006305068B1

(12) United States Patent
Sroka et al.

(10) Patent No.: US 6,305,068 B1
(45) Date of Patent: Oct. 23, 2001

(54) CONTINUOUS HORIZONTAL STRIP CASTING INSTALLATION AND METHOD FOR PRODUCING A COILABLE METAL STRIP

(75) Inventors: Anwar von Sroka, Kettenkamp; Hubertus Brüning, Mettingen; Hartmut Oelmann, Osnabrück, all of (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/352,022

(22) Filed: Jul. 12, 1999

(30) Foreign Application Priority Data

Jul. 11, 1998 (DE) ..... 198 31 111

(51) Int. Cl.[7] ..... B21B 1/46

(52) U.S. Cl. ..... 29/527.7; 164/413; 164/454; 72/146; 72/214; 29/336

(58) Field of Search ..... 29/527.7, 33 C; 164/413, 417, 454, 476; 72/146, 214

(56) References Cited

FOREIGN PATENT DOCUMENTS 2-211944 * 8/1990 (JP) ..... 164/413

* cited by examiner

*Primary Examiner*—P. W. Echols
(74) *Attorney, Agent, or Firm*—Kenyon & Kenyon

(57) ABSTRACT

A continuous horizontal strip casting installation for producing a metal strip that can be coiled into a coil has a stationary draw-off unit with multiple draw-off rolls at a distance from a chill mold assigned to a furnace, a strip cutting unit which is displaceable in the longitudinal direction of the metal strip drawn out of the chill mold by the draw-off unit, and a coiling unit with coiling rolls, which can also be displaced in the same longitudinal direction. At least one draw-off roll and one coiling roll are driven in synchronization, and their drives are linked together by a programmable controller. The strip cutting unit is arranged between the draw-off unit and the coiling unit and is also linked to the programmable controller and is moved by the metal strip only when the strip is to be cut.

3 Claims, 2 Drawing Sheets

CONTINUOUS HORIZONTAL STRIP CASTING INSTALLATION AND METHOD FOR PRODUCING A COILABLE METAL STRIP

BACKGROUND OF THE INVENTION

The present invention relates to a method for producing a metal strip that can be coiled into a coil in a continuous horizontal strip casting installation, and a horizontal strip casting installation for carrying out this method.

A traditional continuous strip casting installation for producing a coiled metal strip includes first a furnace (holding furnace or hot top) with a chill mold, which determines the cross section of the metal strip. The chill mold typically is flange-mounted at the outlet of the furnace.

A draw-off unit with several draw-off rolls is arranged at a distance from the chill mold. The metal strip is guided horizontally through the draw-off unit between several draw-off rolls extending horizontally. Of the draw-off rolls, at least one draw-off roll is driven. As a rule, however, several draw-off rolls are driven.

If needed, a milling unit for machining the surface of the metal strip may be integrated between the chill mold and the draw-off unit.

The metal strip is guided further in a horizontal plane from the draw-off unit to a coiling unit. The coiling unit is provided with several coiling rolls, which bend the metal strip so that it is deposited in the form of a coil after leaving the coiling unit. The coil is stored on supporting rollers that extend horizontally and are provided above the coiling rolls in the coiling unit.

The coiling unit itself is mounted on rollers and is movable by the metal strip relative to a stationary machine stand.

Between the draw-off unit and the coiling unit there is a strip cutting unit, usually near the draw-off unit, which is movable in the longitudinal direction of the metal strip, is supported on rollers, and which cuts the metal strip when a coil has reached its predetermined diameter.

The drives for the draw-off rolls, the strip cutting unit and the coiling rolls are linked together by a programmable controller.

The coilable metal strip is produced in a Pilger-type reciprocating cycle having a forward stroke of approximately 15 mm and a return stroke of approximately 5 mm with a pause of approximately two seconds inserted between the individual strokes. The relative acceleration of the metal strip here amounts to approximately 4.5 $cm/s^2$. During the entire production of the metal strip in a coil, the coiling unit is attached to the coil sitting on it, with the diameter of the coil increasing constantly, so the draw-off unit must overcome mass acceleration forces of up to approximately 25 tonnes (approximately 4 tonnes to 6 tonnes for the coiling unit, approximately 4 tonnes to 16 tonnes for the coil with its increasing diameter and approximately 2 tonnes for the strip cutting unit if the strip is to be cut). Furthermore, an inertial force of 250 kN must be accelerated and decelerated in each cycle, taking into account the strip draw-off force of approximately 2.5 tonnes.

The coiling unit is shifted by the metal strip between two positions starting from the draw-off unit. A limit switch causes the coiling drive to be turned on and the coiling unit to move back to the starting position along the metal strip. Once it reaches this starting position, another limit switch is operated, turning the coiling drive off again. The distance traveled by the coiling unit amounts to approximately 500 mm. In this procedure, the masses indicated above are accelerated and decelerated back and forth intermittently up to 30 times a minute. With an increase in diameter of the coil and consequently also an increase in weight, the opposing forces become progressively greater, thus causing considerable stresses on the bearings for the coiling rolls but also on the other bearings which must be serviced constantly for this reason and replaced frequently. In addition, the specified draw-off parameters are altered so that reproducibility of the cycles is impossible. An operation with a greater number of cycles per minute is impossible.

SUMMARY OF THE INVENTION

The object of the present invention is to create a method of producing a coiled metal strip and a continuous horizontal strip casting installation for carrying out the method which will avoid high mass acceleration forces and make each individual cycle reproducible.

The present invention meets this object in providing a method (and associated apparatus) for producing a metal strip that can be coiled into a coil in a continuous horizontal strip casting installation. The metal strip is drawn out of a chill mold assigned to a furnace by a draw-off unit having draw-off rolls in a Pilger-type reciprocating cycle with a forward stroke and a return stroke of a shorter length. The strip is conveyed via a strip cutting unit to a coiling unit, which is displaceable in the longitudinal direction of the metal strip, in which the metal strip is rolled into a coil supported by rollers. At least one coiling roll of the coiling unit and at least one draw-off roll of the draw-off unit are driven in synchronization in the cycle of the forward stroke and the return stroke of the metal strip.

A primary point of the present invention is the measure whereby at least one coiling roll of the coiling unit and at least one draw-off roll of the draw-off unit are driven in synchronization in the cycle of the forward stroke and the return stroke of the metal strip, i.e. the draw-off unit and the coiling unit are equipped with synchronized drives. The strip cutting unit is also included here if it is involved in this action. In this way, the Pilger-type reciprocating cycle consisting of a forward stroke and a return stroke of a shorter length takes place only in the metal strip. The unavoidably short strokes in the end phases of the cycles are compensated in the loop of the coil, which develops behind the last coiling rolls of the coiling unit and the coil. The coiling unit thus coils the strip in synchronization with the draw-off unit and need no longer be movable in principle. Only a slight traveling distance of approximately 50 mm is provided, intended for correcting the position of the coiling unit. The movement of the coiling unit along this path of approximately 50 mm, however, takes place over a period of approximately ten hours, so that the relative movement is insignificant.

In principle, within the scope of the present invention only the strip draw-off force of approximately 2.5 tonnes must be taken into account, and the weight of the strip cutting unit of approximately two tonnes must also be taken into account briefly for the time of cutting the metal strip. In other words, this yields a constant 2.5 tonnes upstream and downstream from the cutting of the metal strip at a maximum weight of only 4.5 tonnes. The weight of the coil on the coiling unit is thus of no importance. However, it is important within the scope of the present invention now, due to the method according to the present invention, because of the lack of mass surges in acceleration and deceleration, that all the bearings are protected so that their lifetime is greatly prolonged. The weight of the coil is limited only by the load-bearing capacity of the coiling unit and its machine stand.

Synchronous operation can be achieved with any desired drive unit. Purely electric drives (three-phase servo drives) as well as servo hydraulic drives or purely mechanical drives can be used.

In continuation of the basic idea according to the present invention, the drives of each driven draw-off roll of the draw-off unit and of each driven coiling roll of the coiling unit are linked together by a programmable controller. When there are multiple driven draw-off rolls and coiling rolls, all the draw-off rolls and all the coiling rolls are each controlled separately by a drive, which is then synchronized with the other drive by the programmable controller.

The longitudinal displacement of the strip cutting unit and the cutting mechanism is under the influence of the programmable controller in order to cut the metal strip at the intended time, so that the finished coil can then be removed from the coiling unit and a new coil can be produced.

Finally, the programmable controller makes possible certain other beneficial features, for example, when there are deviations from the synchronous movement sequence, the affected unit is acted upon by a correction factor in the cycle with a positive or negative increment and is thereby kept in a middle position or returned incrementally in a defined period of time. This measure ensures to an even greater extent the reproducibility of the individual cycles from the beginning to the end of the coiling of a coil.

The invention also provides apparatus for practicing the invention in the form of a continuous horizontal strip casting installation that has, in succession, a stationary draw-off unit with multiple draw-off rolls at a distance from a chill mold assigned to a furnace (holding furnace or hot top). The draw-off rolls are preferably arranged one above the other in pairs so they grip the metal strip between them. Furthermore, the continuous horizontal strip casting installation includes a strip cutting unit which is displaceable in the longitudinal direction of and in synchronization with the metal strip drawn out of the chill mold by the draw-off unit. This strip cutting unit goes into operation when a coil has reached a predetermined diameter or a predetermined weight. Then it moves at the same speed as the metal strip during the time of the cutting operation. Finally, the continuous horizontal strip casting installation includes a coiling unit with several coiling rolls which can also be displaced in the longitudinal direction of the metal strip. The coiling rolls, synchronized by their drives with the draw-off rolls, are arranged above and below the metal strip so as to grip the metal strip, convey it further and ultimately bend it so that it is easily coiled. The coiling unit here is thus no longer moved by the metal strip. Due to the advancement of the metal strip exclusively by the draw-off unit, the advancing force of the metal strip is converted into rotational motion of the coil. This coil sits on supporting rollers in the coiling unit. With a forward stroke of approximately 15 mm, the advancing force is converted into rotational motion of the coil, thus eliminating its linear motion. The return stroke is compensated in the loop which develops between the last pair of coiling rolls and the coil itself because of the minimal distance of approximately 5 mm.

As a result of the fact that the drive of the coiling rolls is coupled to the drive of the draw-off rolls and includes the cutting of the strip, negative inertial forces are avoided, so that 40 cycles or more per minute can be achieved easily without having to use drives larger than those actually necessary.

BRIEF DESCRIPTION OF THE DRAWINGS

The present invention is explained in greater detail below on the basis of an embodiment illustrated in the drawings, in which.

DETAILED DESCRIPTION

Figure 1:
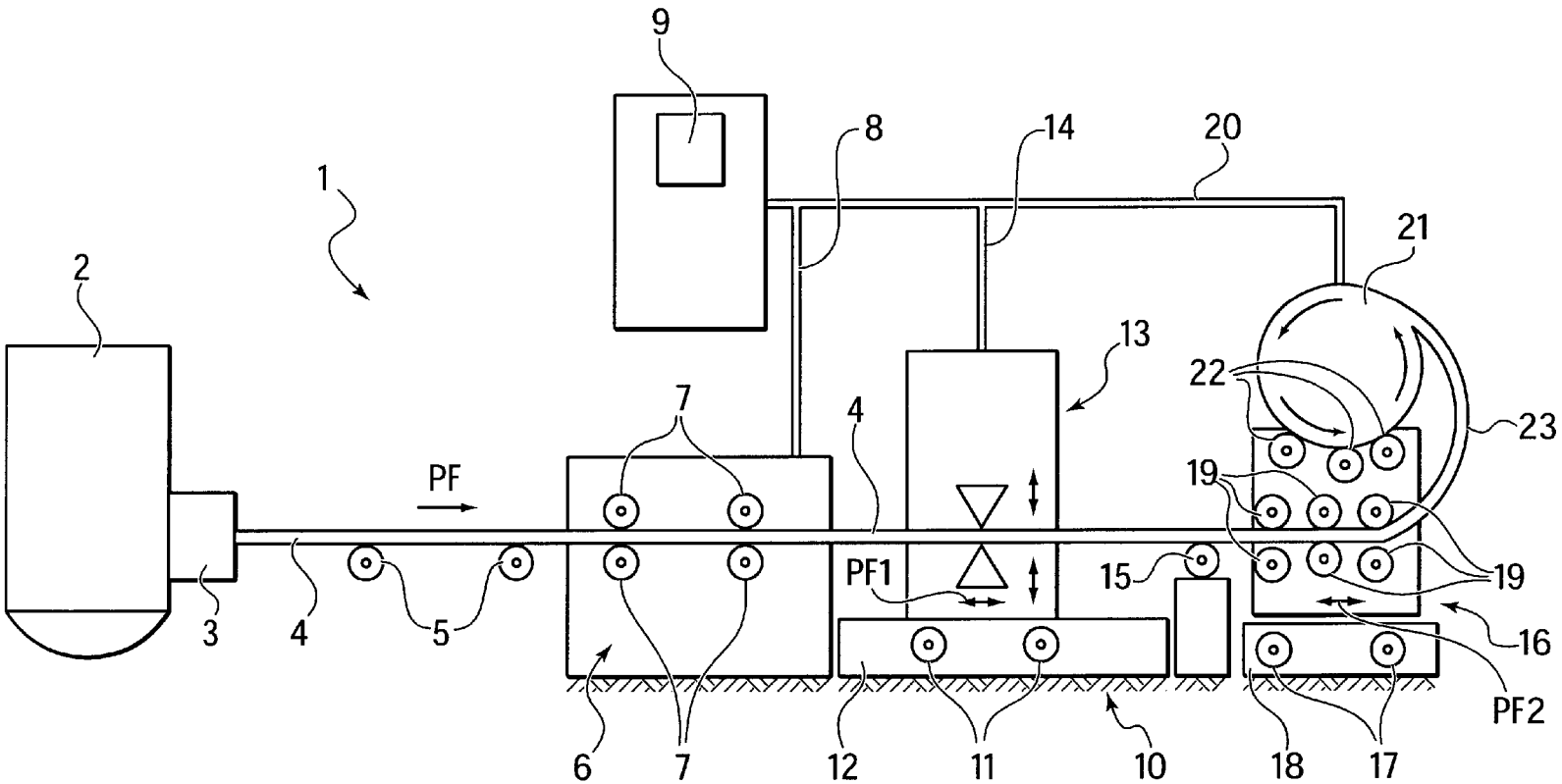
FIG. 1 is a vertical longitudinal sectional diagram of a continuous horizontal strip casting installation constructed according to the principles of the invention.

The continuous horizontal strip casting installation 1 illustrated in FIG. 1 includes first a holding furnace 2 with a cooled chill mold 3 flange mounted on it.

A metal strip 4 which, in this embodiment, has a flat rectangular cross section made of a copper alloy, emerges from chill mold 3. Metal strip 4 is then sent according to arrow PF over carrying rolls 5 in a horizontal plane to a stationary draw-off unit 6 with multiple pairs of draw-off rolls 7. Draw-off rolls 7 are driven by a drive (not shown in detail here) linked by control line 8 to programmable controller 9.

Draw-off rolls 7 are rotated according to a certain cycle first in one direction and then in the other direction, producing a Pilger-type reciprocating action with a forward stroke and a return stroke. As a result of this cycle, metal strip 4 achieves the desired quality in chill mold 3.

In this embodiment, each forward stroke amounts to 15 mm and each return stroke amounts to 5 mm. A pause of two seconds is provided between strokes. The strip draw-off force amounts to approximately 2.5 tonnes. The relative acceleration of metal strip 4 through draw-off rolls 7 is approximately 4.5 $cm/s^2$.

A strip cutting unit 10 with shears 13 is provided downstream from draw-off unit 6 in the direction of movement of metal strip 4. The weight of shears 13, which can be moved by metal strip 4 according to double arrow PF1 on rollers 11 in a stationary roller stand 12 when cutting, is approximately two tonnes.

The drive for the shears (not shown in detail here) is also linked by a control line 14 to programmable controller 9.

Figure 2:
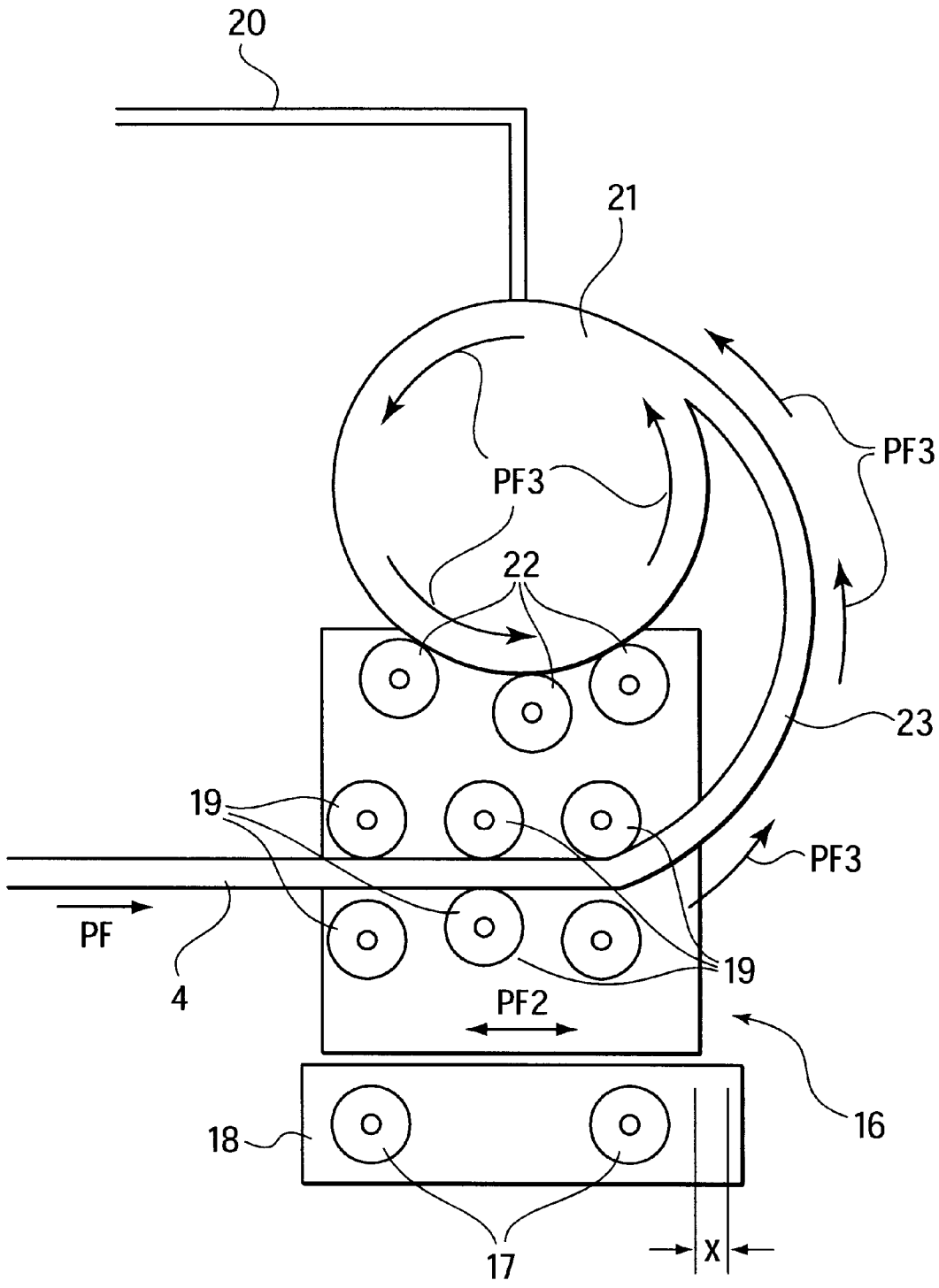
FIG. 2 is an enlarged diagram, also a schematic vertical longitudinal section, of a coiling unit of the continuous horizontal strip casting installation.

Metal strip 4 is conveyed further in the horizontal plane downstream from strip cutting unit 10 and fed to a coiling unit 16 after passing over another carrying roll 15, as indicated in FIG. 2.

Coiling unit 16 is movable back and forth by rollers 17 for a distance X of approximately 50 mm according to double arrow PF2 on a stationary machine stand 18. Several pairs of coiling rolls 19 are provided in coiling unit 16. Coiling rolls 19 are under the influence of a drive (not shown in detail) which is also linked by control line 20 to programmable controller 9. With the help of this controller 9, the drives of draw-off unit 6 and coiling unit 16 are synchronized so that coiling rolls 19 have exactly the same rotational speed as draw-off rolls 7.

Thus, coiling rolls 19 also advance metal strip 4 further in coiling unit 16 over a length of 15 mm in the forward stroke, deforming it at the same time, so that after it leaves coiling unit 16, it has been coiled into a coil 21 which rests on supporting rollers 22 which are also mounted in coiling unit 16. Loop 23 of metal strip 4 between coiling rolls 19 on the outlet side and coil 21 serves to compensate for the return stroke of 5 mm. The compensation distance X of approximately 50 mm is sufficient for this purpose. Correction of the position of rolling unit 16 is completed over a period of approximately ten hours, which means a relative movement of 0.001388 mm/sec.

The coiling direction of metal strip 4 to form coil 21 is designated with arrows PF3.

What is claimed is:

1. A method for producing a metal strip that can be coiled into a coil in a continuous horizontal strip casting installation, comprising the steps of:

drawing the metal strip out of a chill mold that is assigned to a furnace via a draw-off unit that has draw-off rolls in a Pilger-type reciprocating cycle, with a forward stroke and a return stroke of a shorter length;

conveying the metal strip via a strip cutting unit to a coiling unit which is displaceable in the longitudinal direction of the metal strip, in which the metal strip is coiled into a coil supported by rollers;

wherein at least one coiling roll of the coiling unit and at least one draw-off roll of the draw-off unit is driven in synchronization in the cycle of the forward stroke and the return stroke of the metal strip;

wherein, when there are deviations from synchronization in the cycle, the coiling unit is acted upon by a correction factor in the cycle with a positive or negative increment and is thereby kept in a middle position or returned incrementally in a defined period of time.

2. The method as set forth in claim 1, wherein the drives of each driven draw-off roll of the draw-off unit and of each driven coiling roll of the coiling unit are linked together by a programmable controller.

3. A continuous horizontal strip casting installation for carrying, comprising:

a furnace;

a chill mold in proximity to the furnace;

a stationary draw-off unit for drawing the metal strip from the chill mold in a longitudinal direction, said unit having a plurality of draw-off rolls and being located at a distance downstream from the chill mold and the furnace, said unit having a Pilger-type reciprocating cycle;

a strip cutting unit which is displaceable in the longitudinal direction of the metal strip that is drawn out of the chill mold by the draw-off unit;

a coiling unit having coiling rolls which can also be displaced in the same longitudinal direction;

drives for the draw-off rolls, the coiling rolls, and the strip cutting unit; and a programmable controller, wherein at least one draw-off roll and one coiling roll can be driven in synchronization and, the drives of the draw-off and coiling rolls and the strip cutting unit are linked together by the programmable controller; and the installation is configured so that when there are deviations from synchronization in the cycle, the coiling unit is acted upon by a correction factor in the cycle with a positive or negative increment and is thereby kept in a middle position or returned incrementally in a defined period of time.

* * * * *